US007211315B2

(12) United States Patent
Sugita

(10) Patent No.: US 7,211,315 B2
(45) Date of Patent: May 1, 2007

(54) THERMAL TRANSFER PROTECTIVE SHEETS, PRINTS, AS WELL AS PRINTS WITH WINDOW MEMBERS

(75) Inventor: Junichiro Sugita, Tochigi (JP)

(73) Assignees: Sony Corporation, Tokyo (JP); Sony Chemical & Information Device Corporation, Tokyo (JP)

( * ) Notice: Subject to any disclaimer, the term of this patent is extended or adjusted under 35 U.S.C. 154(b) by 0 days.

(21) Appl. No.: 11/419,613

(22) Filed: May 22, 2006

(65) Prior Publication Data

US 2006/0216482 A1 Sep. 28, 2006

Related U.S. Application Data

(63) Continuation of application No. PCT/JP05/00861, filed on Jan. 24, 2005.

(30) Foreign Application Priority Data

Jan. 29, 2004 (JP) ..... 2004-021911

(51) Int. Cl.
*B41M 5/40* (2006.01)

(52) U.S. Cl. ..... 428/195.1; 428/32.81

(58) Field of Classification Search ..... 428/195.1, 428/32.6, 32.77, 32.8, 32.81
See application file for complete search history.

(56) References Cited

U.S. PATENT DOCUMENTS 5,250,133 A * 10/1993 Kawamura et al. ..... 156/240
5,646,089 A * 7/1997 Oshima et al. ..... 503/227

FOREIGN PATENT DOCUMENTS

| | | |
|---|---|---|
| JP | 04-142987 | 5/1992 |
| JP | 2002-002126 | 1/2002 |
| JP | 2003-080844 | 3/2003 |
| JP | 2003-182251 | 7/2003 |
| JP | 2003-211841 | 7/2003 |
| JP | 2003-127558 | 8/2003 |
| JP | 2004-205827 | 7/2004 |

* cited by examiner

*Primary Examiner*—Bruce Hess
(74) *Attorney, Agent, or Firm*—Bell, Boyd & Lloyd LLP

(57) ABSTRACT

A thermal transfer protective sheet, a print, and a print with a window member are provided. The thermal transfer protective sheet includes a release layer and a topcoat layer having adhesiveness to an object to be transferred, which are stacked in this order on a base material, wherein the release layer and the topcoat layer are cold-peeled and transferred to the surface of the object to be transferred by the fusion thermal transfer recording method. The release layer comprises a first resin consisting of a thermoplastic resin and a second resin incompatible with the first resin in a mixed state. The first resin is an acrylic resin, and the second resin is a thermoplastic resin having a glass transition point of 50° C. or less. The mixing ratio of the first resin to the second resin is 80:20 or more and 99:1 or less in a weight ratio. In the release layer, the second resin exists as a particulate phase in the first resin, thereby inhibiting fusion between the base material and the release layer even if cooling is insufficient during peeling.

10 Claims, 1 Drawing Sheet

THERMAL TRANSFER PROTECTIVE SHEETS, PRINTS, AS WELL AS PRINTS WITH WINDOW MEMBERS

CROSS REFERENCES TO RELATED APPLICATIONS

This present application is a Continuation of International Application No. PCT/JP2005/000861, filed Jan. 24, 2005 which claims priority to Japanese Patent Document No. 2004-021911 filed on Jan. 29, 2004. The entire disclosures of the prior applications are hereby incorporated by reference herein its entirety.

BACKGROUND

The present invention generally relates to thermal transfer protective sheets. More specifically, the present invention relates to thermal transfer protective sheets that include a release layer and a topcoat layer laminated in this order on a base material, as well as prints obtained by using them.

Thermal transfer recording methods using thermal transfer recording media including colored layers such as ink layers formed on a base material are widely employed as methods for recording images on cards such as license cards and credit cards. Thermal transfer recording methods are classified into the fusion thermal transfer recording method and the dye sublimation thermal transfer recording method.

For example, mainstream for thermal transfer recording media used in the fusion thermal transfer recording method have a structure including ink layers mainly including waxes having relatively low melting or softening points formed on a base material consisting of a polyester film or the like so that the ink layers are molten/softened by the heat of a thermal head provided in a printer and transferred to an object to be transferred such as a label, paper, tag or the like, whereby printing is accomplished.

Thermal transfer recording media used in the dye sublimation thermal transfer recording method have ink layers formed by coating sublimatable or thermally transferable dyes to be thermal transferred on a base material consisting of a polyester film or the like so that the sublimatable or thermally transferable dyes in the ink layers are transferred by the heat of a thermal head to an object to be transferred, whereby printing is accomplished.

The images formed by the thermal transfer recording methods as described above suffer from low durability such as weather resistance, mar resistance and chemical resistance. Thus, techniques for improving durability by forming a protective layer on the images formed by the thermal transfer recording methods have been proposed. The protective layer is formed by the steps of superimposing a thermal transfer protective sheet having a base material, a topcoat layer (protective layer) formed on the base material upon an object to be transferred bearing an image, applying heat energy from a thermal head to melt or soften the topcoat layer and ink layers and then cooling/solidifying them to transfer the topcoat layer to the object to be transferred.

In a typical thermal transfer protective sheet, a release layer is formed between the base material and the topcoat layer to improve transferability of the topcoat layer to the object to be transferred and peelability from the base material. See, for example, JPA 2003-127558. Many studies have been made about materials for use in the release layer, among which acrylic resins, especially polymethyl methacrylate (PMMA) resins are known as materials having not only durability after printing but also suitable peelability from the base material.

The fusion thermal transfer recording method is classified into the hot peel method and the cold peel method by the timing at which the heated thermal transfer protective sheet is peeled off from the object to be transferred.

In the cold peel fusion thermal transfer recording method, the topcoat layer and the release layer are sufficiently cooled by leaving a relatively long time interval from heating with a thermal head to peeling. The time interval from heating with a thermal head to peeling depends on the structure of the fusion thermal transfer recording printer, i.e. the distance between the heating element of the thermal head for applying heat energy to the thermal transfer protective sheet and a peeling member functioning to peel off the thermal transfer protective sheet and the object to be transferred from the base material.

Under normal appropriate print energy conditions, peeling is readily accomplished and good prints are obtained so far as the release layer consists of a material that is inherently easy to peel off from the base material such as an acrylic resin because the topcoat layer and the release layer are sufficiently cooled during the time interval from heating with a thermal head to peeling.

When heat accumulates in the thermal head by continuous printing or printing is performed at high applied energy, however, cooling is insufficient in the area from the thermal head to the peeling member because the thermal transfer protective sheet becomes hotter than normal.

If the release layer contains a material having a high glass transition point such as an acrylic resin as major component, the release layer fuses to the base material by residual heat. As a result, peel resistance increases to cause so-called sticking such as wrinkles or breakage of the base material, resulting in troubles such as printer shutdown or printing failure. A similar problem is seen when, for example, a high molecular weight PMMA resin is used in the release layer.

An approach proposed to improve peelability was, for example, to add another layer such as a peeling layer using a silicone resin or the like between the base material and the release layer, but this approach has disadvantages such as an increase in production cost due to complex processes associated with the increased number of layers of the thermal transfer protective sheet.

SUMMARY

The present invention was proposed under these circumstances with the aim of providing thermal transfer protective sheets capable of inhibiting fusion of the base material and the release layer without increasing the number of layers of the thermal transfer protective sheets even if the release layer is insufficiently cooled after printing as well as prints using them.

In order to solve the above problems, the present invention provides in an embodiment a thermal transfer protective sheet including a base material, a release layer provided on the base material, and a topcoat layer provided on the release layer, and which is designed in such a manner that when the surface of the topcoat layer on the opposite side to the release layer is pressed against an object to be transferred and heated, the topcoat layer adheres to the object to be transferred, and when the base material is peeled off from the object to be transferred while the topcoat layer remains adhered to the object to be transferred, at least the part of the topcoat layer adhered to the object to be transferred is left on the object to be transferred, wherein the release layer includes a first resin and a second resin mixed with each other, the first resin is a thermoplastic acrylic resin, the second resin is a thermoplastic resin incompatible with the first resin and having a glass transition point of 50° C. or less, and the mixing ratio of the first resin to the second resin in the release layer is 80:20 or more and 99:1 or less in a weight ratio.

In the thermal transfer protective sheet, the release layer in an embodiment has a thickness of 1.0 μm or more and 3.0 μm or less.

In the thermal transfer protective sheet in an embodiment, the ratio of the thickness of the release layer to the thickness of the topcoat layer is 1:2 or more and 10:1 or less.

In the thermal transfer protective sheet in an embodiment, an intermediate layer is provided between the release layer and the topcoat layer, and the intermediate layer contains any one of resins selected from the group consisting of cellulose resins, acrylic resins, polyester resins, polyvinyl alcohols, polyvinyl butyrals and phenoxy resins.

In an embodiment, a print is provided that includes an object to be transferred, an ink layer formed on the surface of the object to be transferred, an adhesive topcoat layer provided on at least the surface of the ink layer, and a release layer provided on the topcoat layer, wherein the release layer has a first resin and a second resin mixed with each other, the first resin is a thermoplastic acrylic resin, the second resin is a thermoplastic resin incompatible with the first resin and having a glass transition point of 50° C. or less, and the mixing ratio of the first resin to the second resin in the release layer is 80:20 or more and 99:1 or less in a weight ratio.

In the print in an embodiment, a plurality of ink layer dots are shaped to construct an image from an assembly of the ink layers, wherein the topcoat layer is provided on the surfaces of the ink layers and the surface of the object to be transferred located between the ink layers.

In an embodiment a print is provided with a window member that includes an object to be transferred, an ink layer formed on the surface of the object to be transferred, an adhesive topcoat layer provided on at least the surface of the ink layer, a release layer provided on the topcoat layer, and a window member provided on the surface of the release layer, wherein the window member is and in close contact with the release layer, and the release layer has a first resin and a second resin mixed with each other, the first resin is a thermoplastic acrylic resin, the second resin is a thermoplastic resin incompatible with the first resin, the second resin have a glass transition point of 50° C. or less, and the mixing ratio of the first resin to the second resin in the release layer is 80:20 or more and 99:1 or less in a weight ratio.

In the print with a window member in an embodiment, the window member contains a plasticizer, and an intermediate layer insoluble in the plasticizer is provided between the topcoat layer and the release layer.

In the print with a window member in an embodiment, the window member includes vinyl chloride as main component, and the window member includes any one of plasticizers, such as, phthalate esters, fatty acid esters, epoxies, phosphoric acid esters, glycerin derivatives, polyesters, the like, and combinations thereof.

In the print with a window member in an embodiment, the intermediate layer contains any one of resins, such as cellulose resins, acrylic resins, polyester resins, polyvinyl alcohols, polyvinyl butyrals, phenoxy resins, the like, and combinations thereof.

The thermal transfer protective sheet in an embodiment includes a release layer and a topcoat layer having adhesiveness to an object to be transferred, which are stacked in this order on a base material, wherein the release layer and the topcoat layer are cold-peeled and transferred onto the surface of the object to be transferred by the fusion thermal transfer recording method, and the sheet is characterized in that the release layer includes a first resin including a thermoplastic resin and a second resin incompatible with the first resin in a mixed state; the first resin is an acrylic resin; the second resin is a thermoplastic resin having a glass transition point of 50° C. or less; and that the mixing ratio of the first resin to the second resin is 80:20 or more and 99:1 or less in a weight ratio.

When two resins incompatible with each other are mixed, they form various domain structures depending on the mixing ratio, and if an amount of either one resin (major component) is overwhelmingly large over the other resin (minor component), the minor component exists as a dispersed microparticulate phase in a phase of the major component to form a so-called sea islands structure.

In the thermal transfer protective sheet in an embodiment, the release layer comprises a first resin as major component and a second resin incompatible with the first resin in a mixed state, whereby the second resin exists as a particulate phase in the first resin.

As a result, the release layer can be inhibited from fusing to the base material and readily peeled even if cooling is insufficient during peeling, for example, when heat accumulates in the thermal head or the like by continuous printing or when printing is performed at excessive print energy due to setting errors or the like or when hot peeling is performed. Thus, transferability of the topcoat layer can be improved.

The reasons for this may be explained as follows.

When the release layer is heated, the microdomain structure in the release layer melts and the two phases begin to be mixed in the molten state while consuming a part of the excessive energy for mixing them, whereby the heat energy from the thermal head decreases.

Even if cooling is insufficient at the instant of peeling, the particulate second resin having a low glass transition point reduces the cohesive force of the release layer.

The print in an embodiment is formed by using a thermal transfer protective sheet including a release layer and a topcoat layer having adhesiveness to an object to be transferred, which are stacked in this order on a base material. The print is formed by cold-peeling and transferring at least a part of the release layer and the topcoat layer of the thermal transfer protective sheet to the surface of the object to be transferred by the fusion thermal transfer recording method, and characterized in that the release layer comprises a first resin consisting of a thermoplastic resin and a second resin incompatible with the first resin in a mixed state; the first resin is an acrylic resin; the second resin is a thermoplastic resin having a glass transition point of 50° C. or less; and that the mixing ratio of the first resin to the second resin is 80:20 or more and 99:1 or less in a weight ratio.

Such a print is formed by transferring the topcoat from a thermal transfer protective sheet having a release layer containing a first resin consisting of a thermoplastic resin and a second resin incompatible with the first resin in a mixed state, whereby the release layer can be inhibited from fusing to the base material and readily peeled even if the release layer is insufficiently cooled during peeling. Thus, a print having a protective layer (topcoat layer) on an image can be relatively easily obtained.

When the thermal transfer protective sheet in an embodiment is used, satisfactory printing can be achieved without causing printer shutdown or other troubles by inhibiting sticking such as wrinkles or breakage of the base material because the release layer can be readily peeled off from the base material over a wide print energy range. According to an embodiment, the increase in production cost due to the increased number of layers can be reduced because no additional layer is required to readily peel off the release layer from the base material.

According to an embodiment, prints having a transferred topcoat layer can be relatively easily obtained by using the thermal transfer protective sheet capable of satisfactory printing with reduced incidence of sticking.

Additional features and advantages of the present invention are described in, and will be apparent from, the following Detailed Description of the Invention and the figures.

Figure 1:
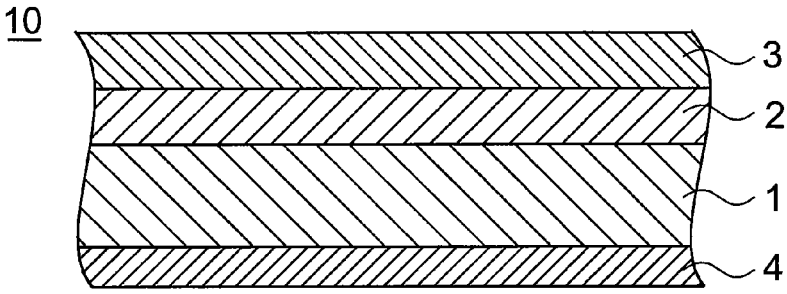
FIG. 1 is a sectional view illustrating an example of a thermal transfer protective sheet of an embodiment of the present invention.

In the drawings, reference 1 represents a base material, reference 2 represents a release layer, reference 3 represents a topcoat layer (adhesive layer), reference 4 represents a backcoat layer, reference 5 represents an intermediate layer, references 10, 16 represent thermal transfer protective sheets, references 15, 25 represent prints, and reference 20 represents a print with window members.

DETAILED DESCRIPTION OF THE INVENTION

Thermal transfer protective sheets and prints according to an embodiment of the present invention are explained below with reference to the drawings.

Thermal transfer protective sheets in an embodiment are intended to form a protective layer by the fusion thermal transfer method on the surface of an object to be transferred or the like after an image has been formed on it by a given recording method such as the fusion thermal transfer recording method or sublimation thermal transfer recording method, for example.

FIG. 1 shows an example of a thermal transfer protective sheet pursuant to an embodiment the present invention. This thermal transfer protective sheet 10 includes a release layer 2 for controlling the transferability of a topcoat layer 3 serving as an adhesive layer and intended to be transferred to the object to be transferred side wherein the release layer 2 and the topcoat layer 3 are formed in this order on one major surface of a film-like base material 1, and it also comprises a backcoat layer (heat-resistant lubricant layer) 4 for improving the heat-resistant lubricity of the thermal transfer protective sheet 10 formed on the other major surface of the base material 1.

Release layer 2 is provided immediately on base material 1 and it is molten by heat energy and peeled off from base material 1 to improve the transferability of topcoat layer 3 during thermal transfer, while it adheres well to base material 1 and topcoat layer 3 in normal times (not during thermal transfer). Release layer 2 is transferred with topcoat layer 3 to the surface of the counterpart object to be transferred during printing.

In an embodiment, a mixture of specific types of resins is used in release layer 2. That is, release layer 2 includes a first resin consisting of a thermoplastic resin as major component and a second resin incompatible with the first resin as minor component. When different types of incompatible resins are mixed, they form various domain structures depending on the mixing ratio, among which the second resin exists as a particulate phase in the major component first resin in release layer 2.

The incompatibility of resins here can be identified by turbidity in a mixed solution of single resin solutions or by microscopic examination of phase separation in a mixed solution of single resin solutions applied and dried on a transparent base, among which the latter method is used to identify the incompatibility of resins according to an embodiment.

Specifically, the following method can be performed:

(1) Prepare a solution of a first resin as major component dissolved in a solvent and a solution of a second resin as minor component dissolved in a solvent.

(2) Mix these solutions in a solids ratio of first resin/second resin=90/10 in a weight ratio and thoroughly stir the mixture to prepare a coating solution for observation.

(3) Apply the coating solution for observation in a dry thickness of 1.0 μm or more and 2.0 μm or less on a transparent glass plate.

(4) Observe the sample applied and dried on the glass plate under a light microscope at 700× magnification. Then, only a homogeneous phase is observed in applied samples consisting of single resins or applied samples prepared by compatible resins. A particulate phase of the second resin can be identified in a phase consisting of the first resin when incompatible resins are mixed.

Solvents for preparing the solutions above include, for example, alcohols such as ethanol, n-propanol, isopropyl alcohol (IPA), n-butyl alcohol; esters such as ethyl acetate, n-butyl acetate; ketones such as acetone, methyl ethyl ketone (MEK), methyl isobutyl ketone (MIBK), cyclohexanone; ethers such as tetrahydrofuran (THF); cellosolves such as ethyl cellosolve, n-butyl cellosolve, cellosolve acetate; and aromatic solvents such as toluene, xylene and benzene, the like, and combinations thereof. In any case, solvents in which both of the first resin and the second resin can be dissolved are preferred, such as a mixed solvent of MEK/toluene=80/20 (weight ratio).

The first resin constituting the major component of release layer 2 preferably includes, for example, an acrylic resin because it has not only suitable peelability from base material 1 but also durability of the print after transfer. For the purpose of obtaining mar resistance in the print after transfer, the first resin preferably has a glass transition point higher than 50° C. and a weight average molecular weight of 10,000 or more.

Specifically, the first resin preferably contains any one of acrylic resins, such as polymethyl methacrylates, polyethylene methyl acrylates, and styrene-acrylic copolymers, and the first resin may include one of these acrylic resins or a mixture of two or more of the acrylic resins.

The second resin constituting the minor component of release layer 2 preferably includes a thermoplastic resin having a glass transition point lower than that of the first resin, more specifically, a glass transition point of 50° C. or less, such as polyester resins, acrylic resins, polyamide resins, ethylene vinyl acetate copolymers (EVAs), polycaprolactone resins, epoxy resins, the like, and combinations thereof. If the glass transition point of the second resin exceeds 50° C., peelability may be insufficient when release layer 2 is insufficiently cooled.

Release layer 2 may include, for example, known waxes, fillers such as inorganic and organic fillers or the like as needed.

A process for forming an image on an object to be transferred by the thermal transfer recording method is explained by way of example.

The thermal transfer recording method typically uses a thermal head as a heating means. The heating face of the thermal head is pressed against the surface opposite side of the surface of a substrate having ink layers. The surfaces of ink layers are in contact with an object to be transferred while the thermal head is heating the ink layers.

If the ink layers include dye inks, the dye inks in the heated part sublime and deposit on the object to be transferred to form ink layers of the dye inks. If the ink layers include pigment inks, the pigment inks in the heated part melt and adhere to the object to be transferred, and when the substrate is removed from the object to be transferred, the adhered pigment inks are severed from the remaining part and left on the surface of the object to be transferred to form ink layers of the pigment inks.

The thermal head has a plurality of heating elements. When a current is applied to selected heating elements to heat desired region of the heating face, ink layers are formed in dots at desired region of the surface of the object to be transferred to construct an image such as letters or graphics from an assembly of the ink layers shaped dots.

Thermal transfer protective sheet 10 in an embodiment forms a protective layer on an image on an object to be transferred by the fusion thermal transfer recording method.

A process for forming a protective layer on an image is specifically explained as follows. A heating means is pressed against the surface of thermal transfer protective sheet 10 on the opposite side to topcoat layer 3, and the surface of thermal transfer protective sheet 10 on the side having topcoat layer 3 is contacted with the surface of an object to be transferred on the side having an image.

The heating means can be a thermal head, for example. When the thermal transfer protective sheet 10 is heated by applying suitable print energy via the heating means, the heated portion of the release layer and topcoat layer soften or melt. When topcoat layer 3 is heated while it is in contact with an object to be transferred, the heated part of topcoat layer 3 adheres to the object to be transferred because the topcoat layer 3 comprises an adhesive material developing adhesiveness by softening or melting.

When only the region, for example, overlying the image on thermal transfer protective sheet 10 is heated, topcoat layer 3 adheres to the surfaces of ink layers constituting the image and to the surface of the object to be transferred exposed between the ink layers, but does not adhere to the surface of the object to be transferred exposed outside the image because the heating means such as a thermal head can heat only desired regions of the thermal transfer protective sheet.

Even when heating with the thermal head is terminated and the heated portion of release layer 2 and topcoat layer 3 are cooled/solidified, the heated portion of topcoat layer 3 remains adhered to the surfaces of ink layers constituting the image and to the surface of the object to be transferred located between the ink layers. The adhesive force is greater than the force required to sever topcoat layer 3.

Thus, when base material 1 is removed from object to be transferred 11 after cooling, the heated portion of topcoat layer 3 is severed from the remaining part and remains adhered to the object to be transferred (transferred) and the remaining part of topcoat layer 3 is separated together with base material 1 from the object to be transferred.

When the heated portion of topcoat layer 3 has been transferred, the heated portion of release layer 2 is peeled off from base material 1 because the adhesive force between release layer 2 and topcoat layer 3 is greater than the adhesive force between base material 1 and release layer 2.

The cohesive force of release layer 2 is reduced because the sea island structure above-described is formed inside of the release layer 2. When the portion part of release layer 2 is peeled off from base material 1, such heated portion is severed from the remaining part of release layer 2 and transferred with the heated part of topcoat layer 3 to the object to be transferred to form a protective layer having the heated portion of topcoat layer 3 and the heated portion of release layer 2 on the object to be transferred.

Figure 3:
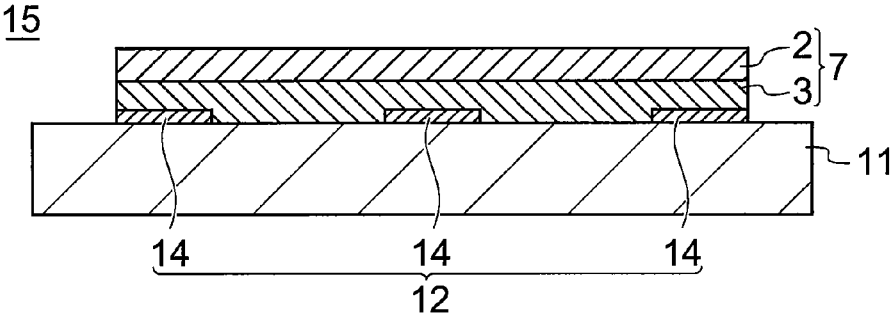
FIG. 3 is a sectional view illustrating an example of a print prepared by using a thermal transfer protective sheet of an embodiment of the present invention.

Reference numeral 15 in FIG. 3 represents a print of the present invention having protective layer 7 formed on the object to be transferred 11. The topcoat layer 3 of this protective layer 7 is provided on the surface of ink layers and the surface of object to be transferred 11 located between dots shaped ink layers 14 while the topcoat layer is in close contact with the surfaces of ink layers 14 and the surface of the object to be transferred exposed between the ink layers 14.

According to the fusion thermal transfer recording method for cold peel as described above, topcoat layer 3 and release layer 2 are sufficiently cooled by leaving a relatively long time interval from heating with a thermal head to peeling.

The time interval from heating with a thermal head to peeling depends on the distance between the heating element of the thermal head for applying heat energy to thermal transfer protective sheet 10 and a peeling member functioning to peel off thermal transfer protective sheet 10 and the object to be transferred or other factors when a fusion thermal transfer recording printer is used, for example.

Under normal appropriate print energy conditions, peeling is readily accomplished and good prints are obtained so far as the first resin of release layer 2 includes a material that is inherently easy to peel off from base material 1 such as an acrylic resin because topcoat layer 3 and release layer 2 are sufficiently cooled during the period from heating with a thermal head to peeling.

When heat accumulates in the thermal head by continuous printing or printing is performed at deliberately high energy or excessive print energy is applied due to setting errors or the like, however, cooling is insufficient in the interval from the thermal head to the peeling member so that topcoat layer 3 and release layer 2 are peeled off while they retain residual heat because thermal transfer protective sheet 10 becomes hotter than normal condition.

Even if release layer 2 is insufficiently cooled during peeling as described above, the thermal transfer protective sheet of the present invention can perform easy peeling and transferring of release layer 2 and topcoat layer 3 to the object to be transferred by inhibiting fusion of release layer 2 onto base material 1, because a mixture of specific resins are included in release layer 2.

As a result, satisfactory printing can be achieved by inhibiting sticking such as wrinkles or breakage of the base material, as well as stable transfer can be achieved by reducing disadvantages such as printer shutdown. The reasons for this may be explained as follows:

(1) When release layer 2 is heated, the microdomain structure in release layer 2 melts and the two phases begin to be mixed in the molten state while consuming a part of the excessive energy for mixing them. Thus, the heat energy from the thermal head decreases as compared with cases where a single resin material is used.

(2) Even if cooling is insufficient at the instant of peeling, the particulate second resin reduces the cohesive force of release layer 2, and therefore, even if release layer 2 fuses to base material 1, cohesion failure occurs in release layer 2. Thus, release layer 2 is readily peeled off from base material 1 by cohesion failure.

As described above, thermal transfer protective sheet 10 in an embodiment allows release layer 2 to be readily peeled off from base material 1 even if cooling is insufficient during peeling. However, the mixing ratio of the first resin as major component to the second resin as minor component is preferably within a specific range to readily peel off release layer 2 from base material 1 even when the print energy is normal, for example, when proper cold peeling is performed.

Specifically, the mixing ratio of the first resin as major component to the second resin as minor component is 80:20 or more and 99:1 or less in a weight ratio, whereby release layer 2 is readily peeled off from base material 1 over a wide range from normal print energy to high print energy and satisfactory transfer can be reliably achieved.

If the proportion of the second resin as minor component is excessive, peel resistance during cold peeling may increase because the particulate microdomain structure cannot be retained. On the other hand, if the proportion of the second resin is too little, peelability may become insufficient when release layer 2 is insufficiently cooled.

Moreover, thermal transfer protective sheet 10 in an embodiment allows the production process to be simplified and the production cost to be reduced because no additional layer for improving peelability is required between base material 1 and release layer 2.

The thickness of release layer 2 is preferably 1.0 μm or more and 3.0 μm or less in view of the function as a protective layer and print quality such as severability or transfer sensitivity. If the thickness of release layer 2 is less than 1.0 μm, the function as a protective layer cannot be expected. Moreover, overlying layers may be mixed each other, and penetrate through them to the base material side during coating or printing. If release layer 2 is excessively thick over 3.0 μm, however, print sensitivity may be deteriorated by poor heat transfer. This also results in poor severability, causing troubles such as burrs or dropping.

As used herein, "severability" means separability when the heated part of release layer 2 is severed from the remaining part of release layer 2, and "dropping" means that release layer 2 falls off from base material 1.

Base material 1 can include a material used in conventional thermal transfer recording media, for example, base materials include papers such as condenser paper and sulfate paper or bases that includes plastics such as polyethylene terephthalate or other polyesters films, polyvinyl chloride films and polycarbonate films can be suitably used.

Topcoat layer 3 preferably includes an adhesive material having adhesiveness to an object to be transferred and inks printed on the surface of the object to be transferred. When ink layers are formed from printed inks on the surface of the object to be transferred, topcoat layer 3 adheres to the surfaces of ink layers, or when printed inks have been absorbed from the surface to the inside of the object to be transferred, topcoat layer 3 adheres to the surface of the part of the object to be transferred in which the inks have been absorbed.

Adhesive materials conferring such adhesiveness on topcoat layer 3 may include, for example, acrylic resins, polyester resins, vinyl chloride resins, vinyl acetate resins, the like, and combination thereof. The thickness of topcoat layer 3 is not specifically limited, but preferably 0.3 μm or more and 2.0 μm or less for practical uses.

As described above, the thickness of release layer 2 is preferably 1.0 μm or more and 3.0 μm or less, and therefore, the ratio of the thickness of the release layer to the thickness of topcoat layer 3 is preferably 1:2 or more and 10:1 or less.

Figure 2:
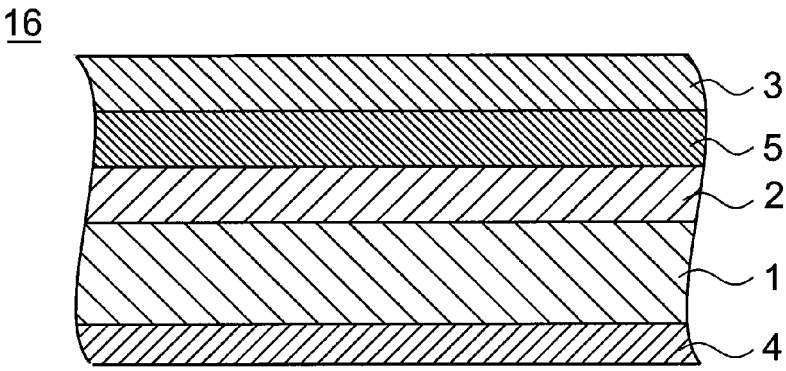
FIG. 2 is a sectional view illustrating another example of a thermal transfer protective sheet of an embodiment of the present invention.

Thermal transfer protective sheet 16 according to another embodiment can include an intermediate layer 5 serving as a barrier layer insoluble in the plasticizer described later between release layer 2 and topcoat layer 3, as shown in FIG. 2.

When thermal transfer protective sheet 16 according to an embodiment is used, topcoat layer 3 and release layer 2 can also be transferred to an object to be transferred to prepare a print by a similar process to that of thermal transfer protective sheet 10 shown in FIG. 1.

Next, a print with window members using thermal transfer protective sheet 16 is explained.

Figure 4:
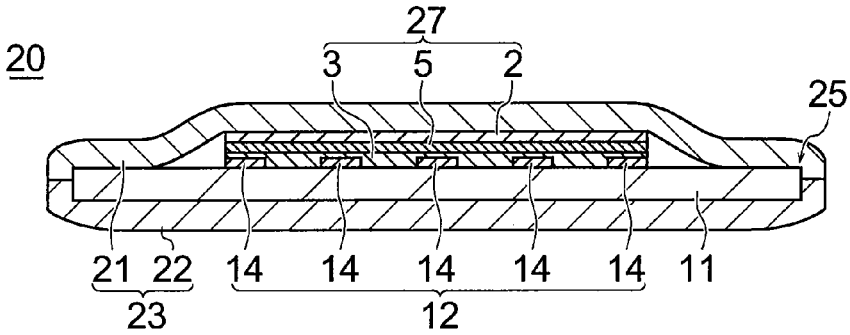
FIG. 4 is a sectional view illustrating an example of a print with window members of an embodiment of the present invention.

Reference numeral 20 in FIG. 4 represents an example of a print with window members of the present invention, and such print 20 with window members includes a first and a second window members 21, 22, and a print 25.

Print 25 includes an object to be transferred 11 and ink layers 14 provided on the surface of object to be transferred 11. Ink layers 14 are formed in dots similarly to print 15 shown in FIG. 3 above, and the surface of object to be transferred 11 is exposed between dot shaped ink layers 14. Topcoat layer 3 is provided on the surfaces of ink layers 14 and the surface of the object to be transferred exposed between ink layers 14. Thus, ink layers 14 and the regions of object to be transferred 11 between ink layers 14, i.e. the regions bearing an image 12 are covered with topcoat layer 3.

An intermediate layer 5 is provided on the topcoat layer 3, and a release layer is provided on intermediate layer 5, thereby forming a protective layer 27.

This protective layer 27 is formed by heating topcoat layer 3 of thermal transfer protective sheet 16 as shown in FIG. 2 while it is in contact with the regions forming image 12 and then peeling off base material 1. When base material 1 is peeled off, interfacial separation between release layer 2 and base material 1 or cohesion failure within release layer 2 occurs.

Thus, intermediate layer 5 covers topcoat layer 3, and release layer 2 is located at least on the surface of a part of intermediate layer 5 in this protective layer 27.

First and second window members 21, 22 are joined together at their edges but a partial opening to form a case 23, and print 25 is inserted into case 23 from the opening formed by unjoined edges.

Here, first and second window members 21, 22 are transparent so that image 12 can be visually observed through first and second window members 21, 22.

First and second window members 21, 22 include a plasticizer for conferring flexibility, and this plasticizer exudes on the surfaces of first and second window members 21, 22 as time passes or temperature varies.

When print 25 is put in case 23, the surface of release layer 2 is in close contact with a window member (here, first window member 21), and release layer 2 becomes dissolved in the plasticizer exuding from first and second window members 21, 22 if print 25 stays within case 23 for a long period. Especially when the thickness of release layer 2 is as thin as 3 μm or less, the dissolution progresses shortly, but the plasticizer does not penetrate through intermediate layer 5 to the side of topcoat layer 3 because intermediate layer 5 comprises a material insoluble or less soluble in the plasticizer and therefore, intermediate layer 5 is not dissolved in the plasticizer even if the plasticizer dissolves release layer 2.

When the plasticizer reaches ink layers 14, bad influences such as discoloration or dissolution are occurred to ink layers 14 by the plasticizer. Especially when ink layers 14 comprise inks readily soluble in the plasticizer such as dye inks, ink layers 14 are significantly dissolved. However, ink layers 14 are not discolored or dissolved as described above, because the plasticizer does not penetrate through intermediate layer 5 to ink layers 14. Thus, print 20 with window members does not suffer smearing of image 12 or disappearance of the image even if print 25 stays in case 23 for a long period because ink layers 14 are not discolored or dissolved.

The material of first and second window members 21, 22 is not specifically limited, but can include a vinyl chloride resin as a major component, for example. The plasticizer is selected depending on the major component of the material, for example, when the major component is a vinyl chloride resin, any one or more plasticizers selected from the group consisting of phthalate esters (e.g., dioctyl phthalate and dibutyl phthalate), fatty acid esters, epoxies (e.g., soybean epoxide oil and octyl epoxy stearate), phosphoric acid esters, glycerin derivatives, polyesters, the like, and combinations thereof can be used.

The material of first and second window members 21, 22 may contain additives other than the plasticizer such as colorants, flame retardants and stabilizers, or the print with window members of the present invention may not contain any plasticizer in the window members.

The material used for intermediate layer 5 is not specifically limited so far as it is insoluble in the plasticizer. In view of the tendency of the plasticizer described above that is relatively less absorbed in resins readily soluble in polar solvents, it is preferable to use resins readily soluble in polar solvents such as, cellulose resins, acrylic resins, polyester resins, PVAs (polyvinyl alcohols), PVBs (polyvinyl butyrals) and phenoxy resins, among which any one resin can be used alone for the intermediate layer or a mixture of two or more resins can be used for the intermediate layer.

Although the foregoing embodiment relates to the case in which both sides of print 25 are covered with window members 21, 22, the present invention is not limited to such an embodiment and a window member may be provided only on the side of print 25 provided image 12 or a window member may be provided only on image 12. The method for providing the window member is not specifically limited either, and the window member may be affixed to the surface of the release layer by thermocompression bonding or the like.

Prints 15, 25 include above mentioned protective layers 7, 27 formed on image 12 on the object to be transferred 11 are specifically used as license cards, credit cards, ID cards, and the like.

Thermal transfer protective sheet 10 can be prepared by a conventional process. That is, the process may include applying a composition for forming release layer 2 on base material 1 by gravure coating or the like, and then applying a composition for forming topcoat layer 3 thereon by gravure coating or the like.

To prepare thermal transfer protective sheet 16 having intermediate layer 5 between release layer 2 and topcoat layer 3 as shown in FIG. 2, the process may include applying a composition for forming release layer 2, then applying a composition for forming intermediate layer 5, and then applying a composition for forming topcoat layer 3. The process for preparing the thermal transfer protective sheet is not limited to the process as described above, and any suitable process can be selected depending on the material of the thermal transfer protective sheet or the like.

A multilayer film having release layer 2 and topcoat layer 3 or a multilayer film having release layer 2 and intermediate layer 5 and topcoat layer 3 may be formed alone on base material 1 or may be formed on base material 1 with ink layers such as dye ink layers or pigment ink layers. An example of a process for forming a print using a thermal transfer protective sheet having a multilayer film and ink layers formed on the same base material 1 as described above comprises setting the thermal transfer protective sheet to a printer, transferring the ink layers to an object to be transferred using the thermal head of the printer, and subsequently transferring the multilayer film using the same thermal head, whereby transfer of the ink layers and formation of a protective layer can be continuously performed.

By using the thermal transfer protective sheets 10, 16 as described above, a print 15 including, for example, a protective layer having a topcoat layer 3 and a release layer 2 or a protective layer having a topcoat layer 3, an intermediate layer 5 and a release layer 2 formed on an object to be transferred can be obtained.

Heat energy is applied to a desired region of thermal transfer protective sheet 10 using a thermal head or the like of a fusion thermal transfer printer while thermal transfer protective sheet 10 is superimposed on a given object to be transferred in such a manner that topcoat layer 3 faces the object to be transferred. After release layer 2 and topcoat layer 3 are cooled/solidified, thermal transfer protective sheet 10 is removed from the object to be transferred using a peeling member or the like of the fusion thermal transfer printer, thereby inducing separation at the interface between base material 1 and release layer 2 of thermal transfer protective sheet 10 to give a print having a protective layer comprising topcoat layer 3 and release layer 2 transferred to the desired region of the object to be transferred.

An example of thus obtained print is shown in FIG. 3. Reference 15 in FIG. 3 represents a print, and such print 15 comprises a given image 12 formed on the surface of an object to be transferred 11 and a protective layer 7 comprising a topcoat layer 3 and a release layer 2 transferred from a thermal transfer protective sheet 10 and laminated in the order mentioned on the image 12.

By providing protective layer 7 on image 12 on the surface of object to be transferred 11, durability such as mar resistance, weather resistance and chemical resistance can be conferred.

The object to be transferred 11 for the print can be selected from various materials, for example, object to be transferreds consisting of papers such as plain paper and woodfree paper; or plastics such as polyethylene terephthalate or other polyesters, vinyl chloride and polycarbonate can be suitably used, and its shape and thickness are not specifically limited, either.

The image 12 formed on the object to be transferred 11 is not limited, either, including, for example, images formed by the fusion thermal transfer method or the sublimation thermal transfer recording method, electrophotographic images, inkjet images, and the like.

FIGS. 3 and 4 show structures in which topcoat layer 3 and release layer 2 have been transferred to only the region of object to be transferred 11 providing image 12. Topcoat layer 3 and release layer 2 may be transferred to any region and topcoat layer 3 and release layer 2 may be transferred to image 12 and its surroundings or to the entire surface of object to be transferred 11 including image 12.

Although the foregoing embodiment relates to the case in which topcoat layer 3 is provided on both of the surfaces of ink layers 14 and the surface of object to be transferred 11, the present invention is not limited to such an embodiment and topcoat layer 3 may be provided on only the surfaces of ink layers 14 or only the surface of object to be transferred 11.

In cases where inks have penetrated into the inside of object to be transferred 11 from the surface, topcoat layer 3 may be provided on only the surfaces of the parts of object to be transferred 11 in which the inks have been absorbed (absorbed parts) or may be provided on both of the surfaces of the absorbed parts of object to be transferred 11 and the surface of object to be transferred 11 between the absorbed parts.

In cases where topcoat layer 3 is provided only on the surfaces of ink layers 14, release layer 2 and intermediate layer 5 are also provided only on the surfaces of ink layers 14, and in cases where topcoat layer 3 is provided on both of the surfaces of ink layers 14 and the surface of object to be transferred 11, release layer 2 and intermediate layer 5 are also provided on both of the surfaces of ink layers 14 and the surface of object to be transferred 11.

In cases where topcoat layer 3 is provided on only the surfaces of the absorbed parts, release layer 2 and intermediate layer 5 are also provided on only the surfaces of the absorbed parts, and in cases where topcoat layer 3 is provided on both of the surfaces of the absorbed parts and the surface of object to be transferred 11, release layer 2 and intermediate layer 5 are also provided on both of the surfaces of the absorbed parts and the surface of object to be transferred 11.

Specific examples in which the present invention has been applied are explained below on the basis of experimental results. However, the present invention is not limited to the description of the examples below mentioned.

Preparation of Thermal Transfer Protective Sheets

Sample 1

A coating solution for forming a release layer was prepared as follows. A first resin consisting of polymethyl methacrylate (available from Mitsubishi Rayon Co., Ltd. sold under the name "Dianal BR80") and a second resin consisting of a polyester resin (available from Unitika Ltd. sold under the name "Elitel UE3230") were dissolved at a weight ratio of 95/5 in a solvent (a mixed solvent of MEK/toluene=80/20 (weight ratio)) to prepare a coating solution for forming a release layer having a solid content of 20% by weight.

This coating solution for forming a release layer was applied using a #5 coil bar on the top surface of a base material having a heat-resistant lubricant layer formed by coating on the bottom surface and dried to form a release layer having a dry thickness of 1.0 μm.

The heat-resistant lubricant layer was formed by applying a mixture of 9 parts by weight of cellulose acetate (available from Daicel Chemical Industries, Ltd. sold under the name "L-70") and 1 part by weight of silicone oil (available from Dow Corning Toray Co., Ltd. sold under the name "SF8410") in a dry thickness of 1.0 μm using a coil bar on the opposite side of the base material to the side on which the release layer was to be formed, and then drying it.

An adhesive layer (topcoat layer) having a dry thickness of 1.5 μm was formed by applying a coating solution for forming a topcoat layer prepared by dissolving a polyester resin (available from Unitika Ltd. sold under the name "Elitel UE3380") in a solvent MEK on the release layer and drying it to give a thermal transfer protective sheet of sample 1.

The two resins used in the release layer of sample 1 were tested for compatibility by microscopically examining phase separation of a mixed solution of the single resin solutions applied and dried on the base material. As a result, a particulate phase of the second resin could be identified in a phase consisting of the first resin, showing that the second resin is incompatible with the first resin.

Sample 2

A thermal transfer protective sheet was obtained in the same manner as for sample 1 except that polymethyl methacrylate (available from Mitsubishi Rayon Co., Ltd. sold under the name "Dianal BR80") was used as the first resin and a polyester resin (available from Unitika Ltd. sold under the name "Elitel UE3215") was used as the second resin and they were mixed at a weight ratio of 99/1 to form a release layer. When the resins in the release layer were tested for compatibility by the same method as for sample 1, a particulate phase of the second resin could be identified in a phase consisting of the first resin, showing that the second resin is incompatible with the first resin.

Sample 3

A thermal transfer protective sheet was obtained in the same manner as for sample 1 except that polymethyl methacrylate (available from Mitsubishi Rayon Co., Ltd. sold under the name "Dianal BR80") was used as the first resin and a polyamide resin (available from Fuji Kasei Kogyo Co., Ltd. sold under the name "TPAE-12") was used as the second resin and they were mixed at a weight ratio of 90/10 to form a release layer. When the resins in the release layer were tested for compatibility by the same method as for sample 1, a particulate phase of the second resin could be identified in a phase consisting of the first resin, showing that the second resin is incompatible with the first resin.

Sample 4

A thermal transfer protective sheet was obtained in the same manner as for sample 1 except that polymethyl methacrylate (available from Mitsubishi Rayon Co., Ltd. sold under the name "Dianal BR80") was used as the first resin and an EVA resin (available from Sumitomo Chemical Co., Ltd. sold under the name "Sumitate RB-11") was used as the second resin and they were mixed at a weight ratio of 90/10 to form a release layer. When the resins in the release layer were tested for compatibility by the same method as for sample 1, a particulate phase of the second resin could be identified in a phase consisting of the first resin, showing that the second resin is incompatible with the first resin.

Sample 5

A thermal transfer protective sheet was obtained in the same manner as for sample 1 except that polymethyl methacrylate (available from Mitsubishi Rayon Co., Ltd. sold under the name "Dianal BR60") was used as the first resin and a polyester resin (available from Toyobo Co., Ltd. sold under the name "Vylon 650") was used as the second resin and they were mixed at a weight ratio of 90/10 to form a release layer. When the resins in the release layer were tested for compatibility by the same method as for sample 1, a particulate phase of the second resin could be identified in a phase consisting of the first resin, showing that the second resin is incompatible with the first resin.

Sample 6

A thermal transfer protective sheet was obtained in the same manner as for sample 1 except that polymethyl methacrylate/polyethylene methyl acrylate (MMA/EMA) (available from Fujikura Kasei Co., Ltd. sold under the name "Acrybase MH-145") was used as the first resin and a polyester resin (available from Toyobo Co., Ltd. sold under the name "Vylon GK330") was used as the second resin and they were mixed at a weight ratio of 90/10 to form a release layer. When the resins in the release layer were tested for compatibility by the same method as for sample 1, a particulate phase of the second resin could be identified in a phase consisting of the first resin, showing that the second resin is incompatible with the first resin.

Sample 7

A thermal transfer protective sheet was obtained in the same manner as for sample 1 except that a styrene-acrylic copolymer (available from Sekisui Chemical Co., Ltd. sold under the name "S-Lec P-595") was used as the first resin and a polyester resin (available from Toyobo Co., Ltd. sold under the name "Vylon 550") was used as the second resin and they were mixed at a weight ratio of 90/10 to form a release layer. When the resins in the release layer were tested for compatibility by the same method as for sample 1, a particulate phase of the second resin could be identified in a phase consisting of the first resin, showing that the second resin is incompatible with the first resin.

Sample 8

A thermal transfer protective sheet was obtained in the same manner as for sample 1 except that polymethyl methacrylate (available from Mitsubishi Rayon Co., Ltd. sold under the name "Dianal BR80") was used as the first resin and an acrylic resin (available from Mitsubishi Rayon Co., Ltd. sold under the name "Dianal BR105") was used as the second resin and they were mixed at a weight ratio of 90/10 to form a release layer. When the resins in the release layer were tested for compatibility by the same method as for sample 1, a particulate phase of the second resin could be identified in a phase consisting of the first resin, showing that the second resin is incompatible with the first resin.

Sample 9

A thermal transfer protective sheet was obtained in the same manner as for sample 1 except that polymethyl methacrylate (available from Mitsubishi Rayon Co., Ltd. sold under the name "Dianal BR80") was used as the first resin and the second resin was not used to form a release layer.

Sample 10

A thermal transfer protective sheet was obtained in the same manner as for sample 1 except that polymethyl methacrylate (available from Mitsubishi Rayon Co., Ltd. sold under the name "Dianal BR80") was used as the first resin and a polyester resin (available from Unitika Ltd. sold under the name "Elitel UE3230") was used as the second resin and they were mixed at a weight ratio of 70/30 to form a release layer. When the resins in the release layer were tested for compatibility by the same method as for sample 1, a particulate phase of the second resin could be identified in a phase consisting of the first resin, showing that the second resin is incompatible with the first resin.

Sample 11

A thermal transfer protective sheet was obtained in the same manner as for sample 1 except that polymethyl methacrylate (available from Mitsubishi Rayon Co., Ltd. sold under the name "Dianal BR80") was used as the first resin and a polyester resin (available from Unitika Ltd. sold under the name "Elitel UE3380") was used as the second resin and they were mixed at a weight ratio of 95/5 to form a release layer. When the resins in the release layer were tested for compatibility by the same method as for sample 1, a particulate phase of the second resin could be identified in a phase consisting of the first resin, showing that the second resin is incompatible with the first resin.

Sample 12

A thermal transfer protective sheet was obtained in the same manner as for sample 1 except that polymethyl methacrylate (available from Mitsubishi Rayon Co., Ltd. sold under the name "Dianal BR80") was used as the first resin and a polyester resin (available from Toyobo Co., Ltd. sold under the name "Vylon 200") was used as the second resin and they were mixed at a weight ratio of 95/5 to form a release layer. When the resins in the release layer were tested for compatibility by the same method as for sample 1, a particulate phase of the second resin could be identified in a phase consisting of the first resin, showing that the second resin is incompatible with the first resin.

Sample 13

A thermal transfer protective sheet was obtained in the same manner as for sample 1 except that polymethyl methacrylate (available from Mitsubishi Rayon Co., Ltd. sold under the name "Dianal BR80") was used as the first resin and an epoxy resin (available from Tohto Kasei Co., Ltd. sold under the name "YDF2004") was used as the second resin and they were mixed at a weight ratio of 90/10 to form a release layer. When the resins in the release layer were tested for compatibility by the same method as for sample 1, no microscopic phase separation was observed between the first resin and the second resin, showing that the second resin is compatible with the first resin.

Sample 14

A thermal transfer protective sheet was obtained in the same manner as for sample 1 except that polymethyl methacrylate (available from Mitsubishi Rayon Co., Ltd. sold under the name "Dianal BR80") was used as the first resin and a polycaprolactone resin (available from Daicel Chemical Industries Ltd. sold under the name "EA1443") was used as the second resin and they were mixed at a weight ratio of 90/10 to form a release layer. When the resins in the release layer were tested for compatibility by the same method as for sample 1, no microscopic phase separation was observed between the first resin and the second resin, showing that the second resin is compatible with the first resin.

Sample 15

A thermal transfer protective sheet was obtained in the same manner as for sample 1 except that polymethyl methacrylate (available from Mitsubishi Rayon Co., Ltd. sold under the name "Dianal BR80") was used as the first resin and an acrylic resin (available from Fujikura Kasei Co., Ltd. sold under the name "FK2P-0102") was used as the second resin and they were mixed at a weight ratio of 90/10 to form a release layer. When the resins in the release layer were tested for compatibility by the same method as for sample 1, no microscopic phase separation was observed between the first resin and the second resin, showing that the second resin is compatible with the first resin.

Sample 16

A thermal transfer protective sheet was obtained in the same manner as for sample 1 except that the thickness of the release layer was 0.5 μm.

Sample 17

A thermal transfer protective sheet was obtained in the same manner as for sample 1 except that the thickness of the release layer was 3.5 μm.

The weight average molecular weight Mw and glass transition point Tg of the first resin used in each release layer of samples 1–17 are shown in table 1. The weight average molecular weight Mw (or number average molecular weight Mn in case of polyesters) and glass transition point Tg of the second resin used in each release layer of samples 1–17 are shown in Table 2. The composition and compatibility of resins of each release layer of samples 1–17 and the thicknesses of the release layer and adhesive layer are shown in Table 3.

TABLE 1

Trade names, manufactures, compositions, weight average molecular weights and glass transition points of the first resins

| Trade name | Manufacturer | Composition | Weight average molecular weight Mw | Glass transition point Tg |
|---|---|---|---|---|
| Dianal BR80 | Mitsubishi Rayon Co., Ltd. | M M A | 95000 | 105 |

TABLE 1-continued

Trade names, manufactures, compositions, weight average molecular weights and glass transition points of the first resins

| Trade name | Manufacturer | Composition | Weight average molecular weight Mw | Glass transition point Tg |
|---|---|---|---|---|
| Dianal BR60 | Mitsubishi Rayon Co., Ltd. | M M A | 70000 | 75 |
| Acrybase MH-145 | Fujikura Kasei Co., Ltd. | M M A/ EMA | 120000 | 88 |
| S-Lec P-595 | Sekisui Chemical Co., Ltd. | Styrene-acrylic | 100000 | 64 |

TABLE 2

Trade names, manufactures, compositions, weight average molecular weights and glass transition points of the second resins

| Trade name | Manufacturer | Composition | Weight average molecular weight Mw | Glass transition point Tg |
|---|---|---|---|---|
| Elitel UE3230 | UNITIKA LTD. | Polyester | 20000 | 3 |
| Elitel UE3215 | UNITIKA LTD. | Polyester | 16000 | 45 |
| Elitel UE3380 | UNITIKA LTD. | Polyester | 8000 | 60 |
| Vylon GK330 | Toyobo Co., Ltd. | Polyester | 17000 | 16 |
| Vylon 550 | Toyobo Co., Ltd. | Polyester | 28000 | −15 |
| Vylon 650 | Toyobo Co., Ltd. | Polyester | 23000 | 10 |
| Vylon 200 | Toyobo Co., Ltd. | Polyester | 17000 | 67 |
| Dianal BR105 | Mitsubishi Rayon Co., Ltd. | Acrylic | | |
| TPAE-12 | Fuji Kasei Kogyo Co., Ltd. | Polyamide | | −60 |
| Sumitate RB-11 | Sumitomo Chemical Co., Ltd | E V A | | <0 |
| FK2P-0102 | Fujikura Kasei Co., Ltd | Acrylic | 37000 | 21 |
| EA1443 | Daicel Chemical Industries, Ltd. | Polycaprolactone | | <0 |
| YDF2004 | Tohto Kasei Co., Ltd. | Epoxy | 2000 | 40 |

TABLE 3

The composition and compatibility of resins of each release layer, and the thicknesses of the release layer and adhesive layer

| | First resin | Second resin | First/second resin mixing ratio | Compatibility | Thickness of release layer (μm) | Thickness of adhesive layer (μm) |
|---|---|---|---|---|---|---|
| Sample 1 | BR80 | UE3230 | 95/5 | Incompatible | 1.0 | 1.5 |
| Sample 2 | BR80 | UE3215 | 99/1 | Incompatible | 1.5 | 1.0 |
| Sample 3 | BR80 | TPAE-12 | 90/10 | Incompatible | 2.0 | 1.0 |
| Sample 4 | BR80 | RB11 | 90/10 | Incompatible | 2.5 | 1.0 |
| Sample 5 | BR60 | Vylon 650 | 90/10 | Incompatible | 1.2 | 1.2 |
| Sample 6 | MH145 | Vylon GK330 | 90/10 | Incompatible | 1.1 | 1.2 |
| Sample 7 | S-Lec P-595 | Vylon 550 | 90/10 | Incompatible | 1.2 | 1.2 |
| Sample 8 | BR80 | BR105 | 90/10 | Incompatible | 1.2 | 1.2 |
| Sample 9 | BR80 | No | 100/0 | — | 1.2 | 1.2 |
| Sample 10 | BR80 | UE3230 | 70/30 | Incompatible | 1.2 | 1.2 |
| Sample 11 | BR80 | UE3380 | 95/5 | Incompatible | 1.2 | 1.2 |
| Sample 12 | BR80 | Vylon 200 | 95/5 | Incompatible | 1.2 | 1.2 |
| Sample 13 | BR80 | YDF2004 | 90/10 | Compatible | 1.2 | 1.2 |
| Sample 14 | BR80 | EA1443 | 90/10 | Compatible | 1.2 | 1.2 |
| Sample 15 | BR80 | FK2P-0102 | 90/10 | Compatible | 1.2 | 1.2 |
| Sample 16 | BR80 | UE3230 | 95/5 | Incompatible | 0.5 | 1.2 |
| Sample 17 | BR80 | UE3230 | 95/5 | Incompatible | 3.5 | 1.2 |

Print Evaluation

A print test was performed on the thermal transfer protective sheets of samples 1–17 prepared as described above. The object to be transferred on which a topcoat layer and a release layer are transferred is a card made from polyvinyl chloride having a thickness of 0.75 mm. A printer available from Datacard sold under the name "Datacard Select 2 AIT" (head resistance: 1789 Ω) was used for fusion transfer with a thermal head. The print energy conditions are shown in Table 4 below.

TABLE 4

| | Print energy conditions | | |
|---|---|---|---|
| | Normal condition | High power condition 1 | High power condition 2 |
| Setting (mv) | 13000 | 14700 | 15000 |
| Applied energy | 0.094 w/dot | 0.120 w/dot | 0.126 w/dot |

Printing was performed under the conditions above and the results were evaluated. The evaluation criteria are as follows.

Evaluation Criteria

<Printing Under Normal Condition (Normal Power)>

○: Good print without uneven peeling or fading.

Δ: Some uneven peeling, but transfer available.

x: Printer failure due to ribbon breakage (breakage of base material 1) or fusion to the object to be transferred.

<High Power Printing>

High power condition 1: A presumed condition under which a high power is applied by heat accumulation during normal continuous printing or setting errors.

High power condition 2: More stringent condition than condition 1. A presumed condition under which continuous printing is performed at high power due to setting errors or the like.

○: Good print without ribbon breakage or fusion.

Δ: Print with slight heat-set wrinkles or uneven peeling.

x: Printer failure due to ribbon breakage or fusion to the object to be transferred.

<Evaluation (Stability of Print Quality from Normal Power Condition to High Power Conditions)>

◎: Satisfactory printing available from normal power to very high power ranges.

○: Fair printing available in most energy ranges except for slight heat-set wrinkles at very high power.

○Δ: Quite fair printing available under somewhat high power condition or heat accumulation.

Δ: Deteriorated print quality under somewhat high power condition or heat accumulation but no difficulty in printer operation.

x: Risk of breakage or fusion under high print power condition or heat accumulation. Printing unavailable even at normal power.

The evaluation results are shown in Table 5 below.

TABLE 5

| | Evaluation results | | | |
|---|---|---|---|---|
| | Normal condition | High power condition 1 | High power condition 2 | Evaluation |
| Sample 1 | ○ | ○ | ○ | ◎ |
| Sample 2 | ○ | ○ | ○ | ◎ |
| Sample 3 | ○ | ○ | X (Ribbon breakage) | ○Δ |
| Sample 4 | Δ (Sligthly poor severability) | ○ | ○ | ○ |
| Sample 5 | ○ | ○ | Δ | ○ |
| Sample 6 | ○ | ○ | ○ | ◎ |
| Sample 7 | ○ | ○ | X (Ribbon breakage) | ○Δ |
| Sample 8 | ○ | Δ | X (Ribbon breakage) | Δ |
| Sample 9 | ○ | X (Peeling failure) | — | X |
| Sample 10 | X (Peeling failure) | — | — | X |
| Sample 11 | ○ | X (Peeling failure) | — | X |
| Sample 12 | Δ (Uneven peeling) | X (Peeling failure) | — | X |
| Sample 13 | X (Peeling failure) | — | — | X |
| Sample 14 | ○ | X (Peeling failure) | — | X |
| Sample 15 | ○ | X (Peeling failure) | — | X |
| Sample 16 | Δ (Uneven peeling) | X (Peeling failure) | — | X |
| Sample 17 | X (Poor severability) | — | — | X |

In Table 5 above, "-" means not determined.

As apparent from Table 5, the thermal transfer protective sheets of samples 1–8 showed good results under both normal condition and high power condition 1, and especially samples 1, 2, 4 and 6 showed very good results without defects such as ribbon breakage or fusion to the object to be transferred even under high power condition 2.

However, sample 9 using an acrylic resin alone endured printing under normal condition, but invited peeling failure during printing under high power conditions. Samples 13–15 showing no microscopic phase separation of the second resin from the first resin also failed to achieve easy peeling under high power conditions.

Sample 10 containing an excessive amount of the second resin failed to retain the particulate microdomain structure so that peel resistance during cold peeling is increased. In the result, it caused print failure under normal condition.

Samples 11 and 12 are examples using resins having glass transition points of 60° C. and 67° C. as the second resins, respectively. These samples endured printing under normal condition, but remained insufficient for easy peeling under high power conditions. In the case of sample 16 using a release layer having a small thickness, uneven peeling or peeling failure was observed. On the other hand, sample 17 using a release layer having a large thickness showed poor severability.

These results show that the release layer should have a composition including a second resin incompatible with a first resin in the thermal transfer protective sheets of the present invention. Especially, it was found that the mixing ratio of the first resin to the second resin should be within the range of 80:20 or more and 99:1 or less in a weight ratio, the release layer should preferably have a thickness of 1.0 μm or more and 3.0 μm or less in order to certainly achieve the advantages of the present invention. More preferably, it was found that the second resin as minor component should preferably have a glass transition point of 50° C. or less.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A thermal transfer protective sheet comprising:

a base material, a release layer provided on the base material, and a topcoat layer provided on the release layer, and which is so designed that when the surface of the topcoat layer on the opposite side to the release layer is pressed against an object and heated, the topcoat layer adheres to the object, and when the base material is peeled off from the object while the topcoat layer remains adhered to the object, at least a part of the topcoat layer adhered to the object remains on the object, wherein the release layer includes a first resin and a second resin mixed with each other, the first resin is a thermoplastic acrylic resin, the second resin is a thermoplastic resin incompatible with the first resin and having a glass transition point of 50° C. or less, the mixing ratio of the first resin to the second resin in the release layer is 80:20 or more and 99:1 or less in a weight ratio, and the release layer has a thickness of 1.0 μm or more and 3.0 μm or less.

2. The thermal transfer protective sheet according to claim 1, wherein a ratio of a thickness of the release layer to a thickness of a topcoat layer is 1:2 or more and 10:1 or less.

3. The thermal transfer protective sheet according to claim 1 further comprising:

an intermediate layer provided between the release layer and the topcoat layer, wherein the intermediate layer includes any one of resins selected from the group consisting of cellulose resins, acrylic resins, polyester resins, polyvinyl alcohols, polyvinyl butyrals, phenoxy resins and combinations thereof.

4. A printed media comprising:

an object, an ink layer formed on a surface of the object, an adhesive topcoat layer provided on at least the surface of the ink layer, and a release layer provided on the topcoat layer, wherein the release layer includes a first resin and a second resin mixed with each other, the first resin is a thermoplastic acrylic resin, the second resin is a thermoplastic resin incompatible with the first resin and having a glass transition point of 50° C. or less, and the mixing ratio of the first resin to the second resin in the release layer is 80:20 or more and 99:1 or less in a weight ratio, and the release layer has a thickness of 1.0 μm or more and 3.0 μm or less.

5. The printed media according to claim 4 further comprising a plurality of ink layers that include a plurality of dots so shaped to construct an image from an assembly of the ink layers, wherein the topcoat layer is provided on a surface of the ink layers and the surface of the object located between the ink layers.

6. The printed media according to claim 4, wherein the object is a card.

7. A printed media with a window member comprising an object, an ink layer formed on the surface of the object, an adhesive topcoat layer provided on at least the surface of the ink layer, a release layer provided on the topcoat layer, and a window member provided on the surface of the release layer, wherein the window member is in close contact with the release layer, and the release layer includes a first resin and a second resin mixed with each other, the first resin is a thermoplastic acrylic resin, the second resin is a thermoplastic resin incompatible with the first resin and the second resin have a glass transition point of 50° C. or less, and the mixing ratio of the first resin to the second resin in the release layer is 80:20 or more and 99:1 or less in a weight ratio, and the release layer has a thickness of 1.0 μm or more and 3.0 μm or less.

8. The printed media with a window member according to claim 7 further comprising:

an intermediate layer insoluble in the plasticizer provided between the topcoat layer and the release layer and, wherein the window member includes a plasticizer.

9. The printed media with a window member according to claim 8, wherein the window member includes vinyl chloride as a major component, and the window member includes any one of plasticizers selected from the group consisting of phthalate esters, fatty acid esters, epoxies, phosphoric acid esters, glycerin derivatives, polyesters, and combinations.

10. The printed media with a window according to claim 8, wherein the intermediate layer includes any one of resins selected from the group consisting of cellulose resins, acrylic resins, polyester resins, polyvinyl alcohols, polyvinyl butyrals, phenoxy resins, and combinations thereof.

* * * * *